US010165880B2

(12) United States Patent
Kim

(10) Patent No.: US 10,165,880 B2
(45) Date of Patent: Jan. 1, 2019

(54) TUMBLER HAVING PELTIER DEVICE

(71) Applicant: Kyung Wook Kim, Busan-si (KR)

(72) Inventor: Kyung Wook Kim, Busan-si (KR)

( * ) Notice: Subject to any disclaimer, the term of this patent is extended or adjusted under 35 U.S.C. 154(b) by 51 days.

(21) Appl. No.: 15/624,496

(22) Filed: Jun. 15, 2017

(65) Prior Publication Data

US 2018/0020854 A1 Jan. 25, 2018

(30) Foreign Application Priority Data

Jul. 21, 2016 (KR) ..... 20-2016-0004215 U

(51) Int. Cl.

| | |
|---|---|
| ***F25B 21/02*** | (2006.01) |
| ***F25D 3/08*** | (2006.01) |
| ***A47G 19/22*** | (2006.01) |
| ***B65D 81/18*** | (2006.01) |
| ***B65D 25/20*** | (2006.01) |
| ***B65D 47/32*** | (2006.01) |
| ***F25B 21/04*** | (2006.01) |

(52) U.S. Cl.

CPC ..... *A47G 19/2288* (2013.01); *A47G 19/2272* (2013.01); *B65D 25/20* (2013.01); *B65D 47/32* (2013.01); *B65D 81/18* (2013.01); *F25B 21/04* (2013.01)

(58) Field of Classification Search

CPC ..... F25B 21/02; F25B 21/04; F25B 2321/02; F25B 2321/021; F25B 2321/0211; F25B 2321/023; F25B 2321/025; F25B 2321/0251; A47G 19/2288; A47G 19/2272; B65D 81/18; B65D 25/20; B65D 47/32

USPC ..... 62/3.2, 3.62, 3.64, 457.1, 457.3, 457.4, 62/457.8

See application file for complete search history.

(56) References Cited

U.S. PATENT DOCUMENTS

| | | | | |
|---|---|---|---|---|
| 2,959,925 | A * | 11/1960 | Frantti Edsel W | A47J 36/2433 136/204 |
| 4,320,626 | A * | 3/1982 | Donnelly | F25D 31/003 62/3.64 |
| 5,042,258 | A * | 8/1991 | Sundhar | A47G 19/2288 62/3.2 |
| 7,089,749 | B1 * | 8/2006 | Schafer | B60H 1/00264 62/3.2 |
| 2004/0194470 | A1 * | 10/2004 | Upadhye | A47J 36/2438 62/3.3 |

FOREIGN PATENT DOCUMENTS

| | | | | |
|---|---|---|---|---|
| CN | 104873065 | | 9/2015 | |
| CN | 204764747 | | 11/2015 | |
| JP | 02154711 | A * | 6/1990 | F25B 21/04 |
| JP | 11051534 | A * | 2/1999 | F25B 21/02 |
| KR | 101597049 | | 2/2016 | |
| KR | 20160076154 | | 6/2016 | |

* cited by examiner

*Primary Examiner* — Joseph Trpisovsky

(74) *Attorney, Agent, or Firm* — IPLA P.A.; James E. Bame

(57) ABSTRACT

A tumbler having a Peltier device includes: a container having a channel formed in a center portion in a longitudinal direction and a circular drink storing part enclosing the channel and storing drink therein; a Peltier device disposed adjacent to an inner wall of the channel of the container and transferring heat from the drink stored in the drink storing part; and a blowing unit installed to a lower portion of the container to supply an air to the channel.

1 Claim, 6 Drawing Sheets

TUMBLER HAVING PELTIER DEVICE

BACKGROUND

The present invention relates to a bumbler having a Peltier device capable of properly adjusting a temperature of a beverage stored therein according to user's preference.

A tumbler generally means a big drinking cup with straight sides and a flat bottom which stores a coffee or beverage therein for drinking purpose.

Since such a tumbler is provided with a lid, the tumbler has good heat reservation and portability, as compared to general cups or containers. Therefore, the tumblers are recently used as containers for storing cold or hot beverage therein.

In particular, take-out coffee shops recently use tumblers so as to reduce disposable cups, and also the use of the tumbler at homes or offices is a gradually growing influence in order to keep the beverage for a long time for drinking purpose.

However, despite the good heat reservation thereof, there is a problem in that a temperature of the beverage is not properly maintained in the state in which it is keeping for a long time. See Korean Patent Laid-Open Publication No. 10-2016-0076154.

SUMMARY OF THE INVENTION

Therefore, the present invention has been made in view of the above problems, and an object of the present invention is to provide a tumbler having a Peltier device capable of properly adjusting a temperature of a beverage stored therein.

According to one aspect of the present invention, there is provided a tumbler including: a container having a channel formed in a center portion in a longitudinal direction and a circular drink storing part enclosing the channel and storing drink therein; a Peltier device disposed adjacent to an inner wall of the channel of the container and transferring heat from the drink stored in the drink storing part; and a blowing unit installed to a lower portion of the container to supply an air to the channel.

The container may include a container body provided with an opening on an upper portion, with the circular drink storing part being formed in the container body, and a lid configured to close the opening of the container body and provided with an outlet which communicates with the channel of the container body, through which the air supplied to the inside of the channel by the blowing unit is discharged to an outside.

The Peltier device is formed in the shape of a hollow cylinder, and is disposed to be brought into contact with the inner wall of the channel of the container.

The blowing unit may include a blower fan rotatably installed to the channel at the lower portion of the container to supply the air in the channel, and a battery installed to the lower portion of the container to supply a power to the blower fan, with a center portion communicating with the channel.

The lid may be provided with an outlet which communicates with the channel.

A control unit may be installed to a side of the container to control the blowing unit.

With the above configuration, the tumbler according to the present invention stores the drink in the container, and operates the Peltier device to store the drink at a proper temperature according to the user's preference. Therefore, the user can take the drink of which the temperature is always maintained at a proper level, thereby improving user's satisfaction.

DETAILED DESCRIPTION OF THE PREFERRED EMBODIMENT

Figure 1:
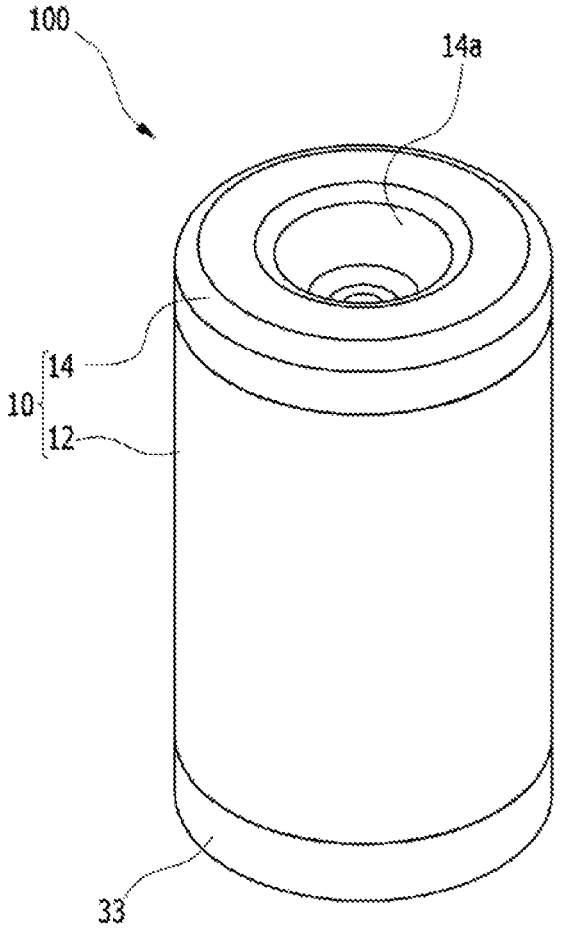
FIG. 1 is a perspective view schematically illustrating a tumbler having a Peltier device according to a first embodiment of the present invention.

Hereinafter, preferred embodiments of the present invention are explained in detail in conjunction with the accompanying drawings so that those skilled in the art can easily carry out the present invention. In the following description, like reference numerals are attached to elements identical to those throughout the embodiment, and the description thereof is omitted herein.

Figure 2:
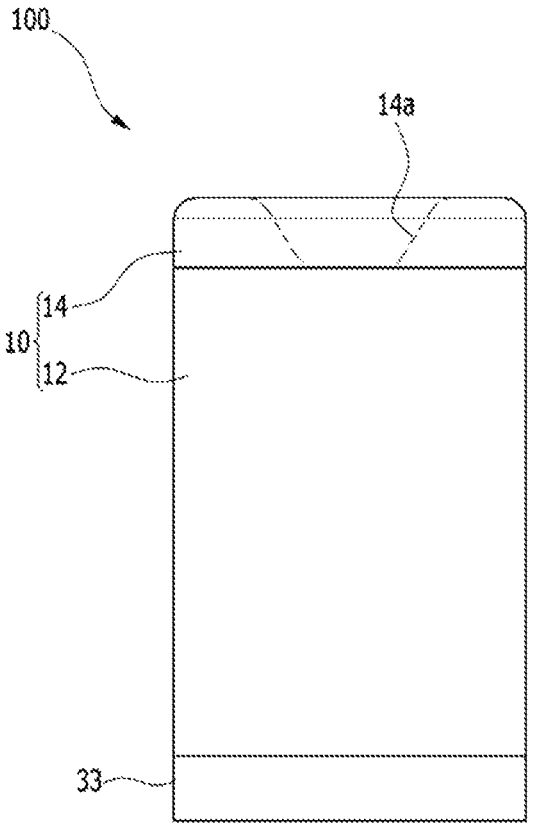
FIG. 2 is a side view schematically illustrating the tumbler having the Peltier device in FIG. 1.
Figure 3:
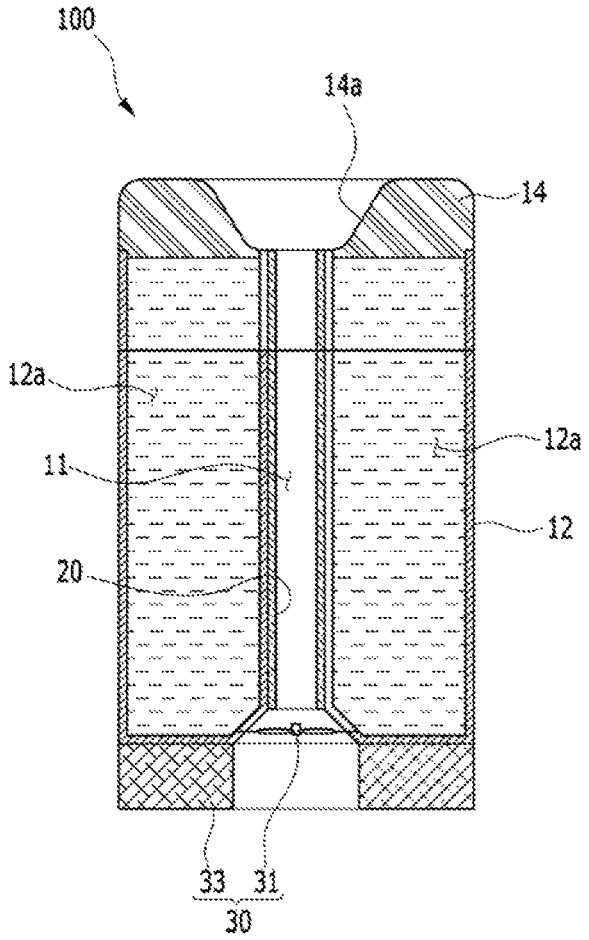
FIG. 3 is a cross-sectional view schematically illustrating the tumbler having the Peltier device in FIG. 1.

FIG. 1 is a perspective view schematically illustrating a tumbler having a Peltier device according to a first embodiment of the present invention. FIG. 2 is a side view schematically illustrating the tumbler having the Peltier device in FIG. 1. FIG. 3 is a cross-sectional view schematically illustrating the tumbler having the Peltier device in FIG. 1.

Referring to FIGS. 1 to 3, a tumbler 100 according to the first embodiment of the present invention includes a container 10 having a channel 11 formed in a center portion in a longitudinal direction and a drink storing part 12*a* for storing drink therein, a Peltier device 20 disposed adjacent to an inner wall of the channel 11 of the container 10 and performing heat exchange between the Peltier device and the drink stored in the drink storing part 12*a*, and a blowing unit 30 installed in the container 10 to supply an air to the channel 11.

The container 10 is formed in a cylindrical shape, and the channel 11 is formed in the center portion of the container in the longitudinal direction.

Specifically, the container 10 may be formed to have a cross section of a donut shape which forms the drink storing part 12*a* around the channel 11 formed in the center portion of the container.

The reason why the container 10 has the donut-shaped cross section is that the Peltier device 20 is attached to the inside of the container along the longitudinal direction, and the drink storing part 12*a* is disposed on the outside of the Peltier device 20 so that the drink stored in the drink storing part is brought into contact with the Peltier device. The Peltier device 20 will be described in detail hereinafter.

The container 10 has a container body 12 with an opening formed on an upper portion, of which the circular drink storing part 12*a* is formed around the channel 11, and a lid for closing the opening of the container body 12.

The container body 12 may be formed to have a cylindrical shape so as to allow a user to easily hold the tumbler by one hand. Of course, the shape of the container body 12 is not limited thereto, but the container body may be formed in the shape of a polygonal surface, or a diameter thereof may be varied along the longitudinal direction.

Alternatively, the container body 12 may be formed properly deformed to have various appearances, with the channel 11 being formed in the center portion.

The container body 12 may be made of a plastic material to properly carry out the heat exchange between the container and the Peltier device 20 while the drink storing part 12*a* stores the drink therein, or may be partially embedded with a metal material which is suitable for the heat exchange.

The container body 12 is provided on the upper portion thereof with the opening through which the drink is introduced into the drink storing part 12*a*. The opening is formed in the shape of a circle to open the upper portion of the container body 12. The opening can be selectively opened or closed by the lid 14.

The lid 14 may be selectively and detachably installed to the upper portion of the container body 12 by a interfering or screwing manner.

The lid 14 is provided with an outlet 14*a* which communicates with the channel 11 of the container body 12, and can be rotatably installed to the upper portion of the container body 12. The reason why the lid 14 is provided with the outlet 14*a* is that since the outlet communicates with the channel 11 of the container body 12, the air can flow consistently in an operation process of the blowing unit 30 which will be described later.

Specifically, the air flowing in the container body 12 is discharged through the outlet 14*a* provided in the container 10.

The Peltier device 20 installed to the inside of the container 10 cools the drink stored in the drink storing part 12*a*.

One side of the Peltier device 20 is brought into contact with a relative hot portion, while the other side is brought into contact with a relative cold portion, thereby cooling the temperature of the hot portion or raising the temperature of the cold portion.

The Peltier device 20 may have a heater which is brought into contact with the hot portion, and a cooler which is brought into contact with the cold portion.

In this embodiment, the Peltier device 20 is installed in the container body 12 along the longitudinal direction of the channel 11, with one side being brought into contact with the drink storing part 12*a*, while the other side being exposed to the air in the channel 11.

Therefore, the Peltier device 20 can cool the drink stored in the drink storing part 12*a* to a desired temperature by a relative temperature difference between the drink and the air supplied to the channel 11.

Of course, the Peltier device 20 can cool or heat the drink stored in the drink storing part 12*a*, if the positions of the heater and cooler are changed in the drink storing part 12*a*.

In this embodiment, the Peltier device 2 is installed in the container 10 to keep the drink stored in the drink storing part 12*a* at a proper temperature according to user's preference.

The blowing unit 30 is installed to the lower portion of the container 10 to supply the air to the inside of the channel 11.

The blowing unit 30 may have a blower fan 31 rotatably installed to the channel 11 at the lower portion of the container 10, and a battery 33 installed to the lower portion of the container 10 to supply a power to the blower fan 31.

The blower fan 31 may be installed to a portion of the channel 11 at the lower portion of the container body 12 constituting the container 10. The embodiment is illustrated in which the blower fan 31 is integrally installed to the lower portion of the container body 12.

Figure 4:
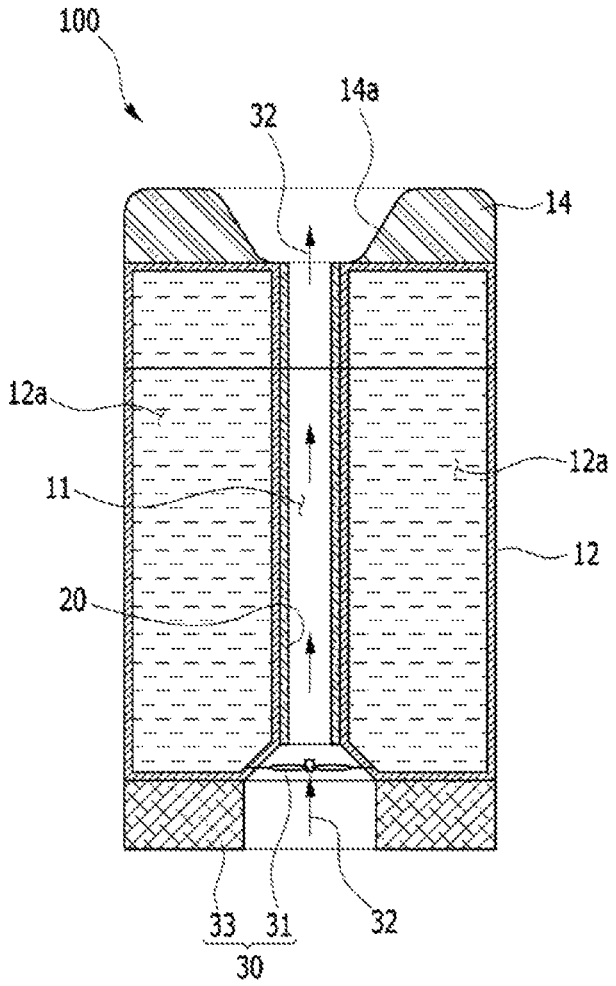
FIG. 4 is a cross-sectional view schematically illustrating a state in which the air flows in the tumbler having the Peltier device in FIG. 1.

FIG. 4 is a cross-sectional view schematically illustrating the state in which the air flows in the tumbler having the Peltier device in FIG. 1.

As illustrated in FIG. 4, the installation of the flower fan 31 is to forcibly supply the air to the inside of the channel 11, so that the temperature of the drink stored in the drink storing part 12*a* can be properly maintained by the air.

The battery 33 is installed to the lower portion of the container body 12, and may include a secondary battery of which charge is easily carried out.

The blower fan 31 is supplied with the power from the battery 33 according to manipulation of the user to supply the air to the inside of the channel 11.

As described above, the tumbler 100 according to this embodiment stores the drink in the container 10, and operates the Peltier device 20 to store the drink at a proper temperature according to the user's preference.

Therefore, the user can take the drink of which the temperature is always maintained at a proper level, thereby improving user's satisfaction.

Figure 5:
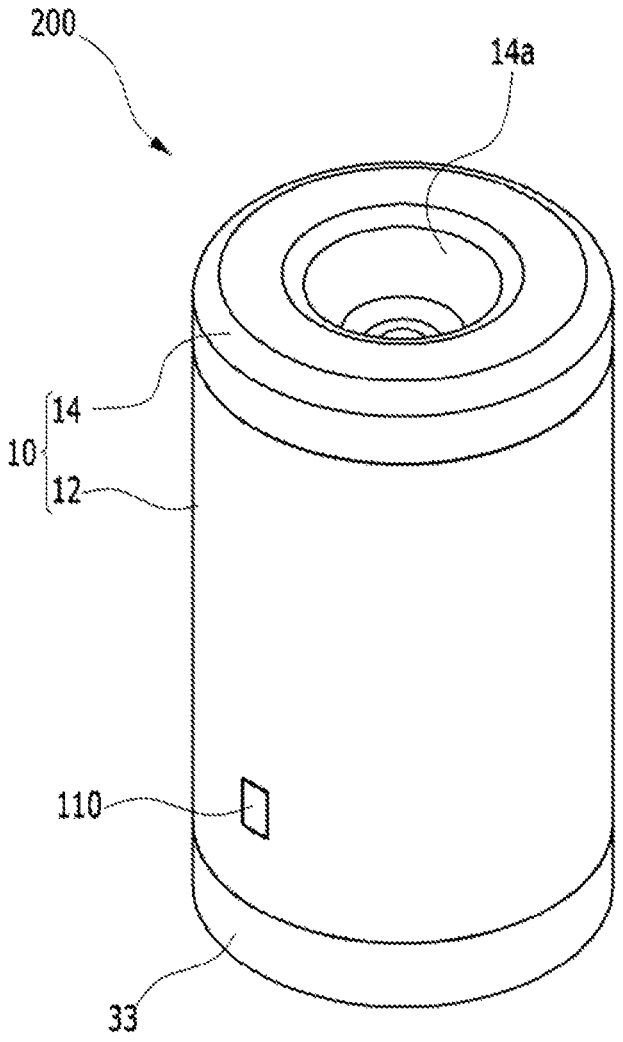
FIG. 5 is a perspective view schematically illustrating a tumbler having a Peltier device according to a second embodiment of the present invention.

FIG. 5 is a perspective view schematically illustrating a tumbler having a Peltier device according to the second embodiment of the present invention. In this embodiment in FIG. 5, like reference numerals are attached to elements identical to those throughout the first embodiment in FIGS. 1 to 4, and the description thereof is omitted herein.

As illustrated in FIG. 5, a tumbler 200 according to the second embodiment includes a control unit 110 provided on a side of the container 10 to control the operation of the blowing unit 30.

The control unit 110 may include a control button to control rotating operation of the blowing fan 31. Accordingly, the user can properly drive the blowing fan 31 by manipulating the control unit 100, thereby adjusting the temperature of the drink.

Figure 6:
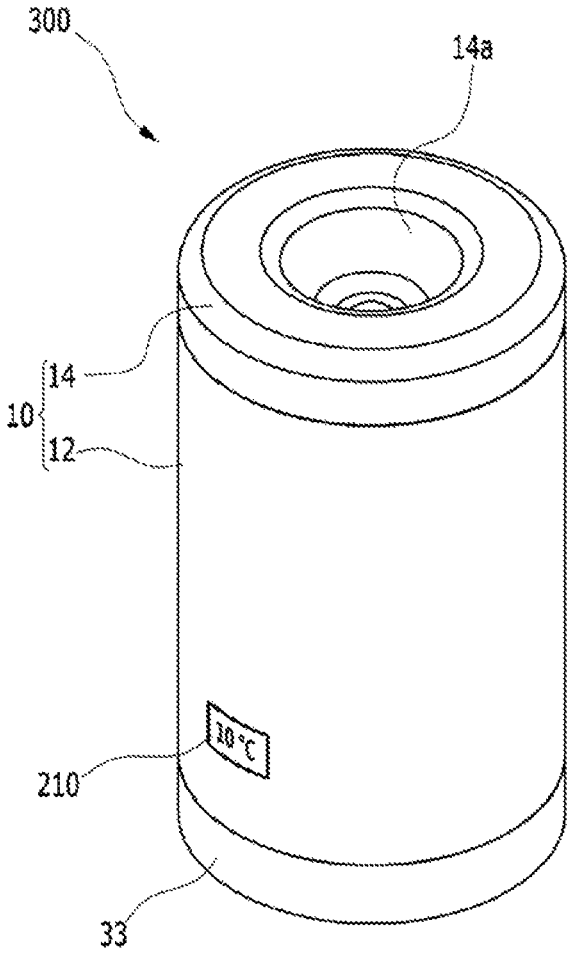
FIG. 6 is a perspective view schematically illustrating a tumbler having a Peltier device according to a third embodiment of the present invention.

FIG. 6 is a perspective view schematically illustrating a tumbler having a Peltier device according to the third embodiment of the present invention. In this embodiment in FIG. 6, like reference numerals are attached to elements identical to those throughout the first embodiment in FIGS. 1 to 4, and the description thereof is omitted herein.

As illustrated in FIG. 6, a tumbler 300 according to the third embodiment includes a temperature display unit 210 provided on a side of the container 10 to display the temperature of the drink.

Therefore, the user can see the temperature displayed on the temperature display unit 210, thereby easily checking the proper temperature of the drink.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A tumbler comprising:

a container having a channel formed in a center portion in a longitudinal direction and a circular drink storing part enclosing the channel and storing drink therein;

a Peltier device of a hollow cylinder disposed to be brought into contact with an inner wall of the channel of the container and transferring heat from the drink stored in the drink storing part;

a blowing unit installed to a lower portion of the container to supply an air to the channel;

a control unit installed to a side of the container to control the blowing unit; and a temperature display unit installed to a side of the container to display a temperature of the drink stored in the drink storing part, wherein the container includes a container body provided with an opening on an upper portion, with the circular drink storing part being formed in the container body, and a lid configured to close the opening of the container body and provided with an outlet which communicates with the channel of the container body, through which the air supplied to the inside of the channel by the blowing unit is discharged to an outside, and the blowing unit includes a blower fan rotatably installed to the channel at the lower portion of the container to supply the air in the channel, and a battery installed to the lower portion of the container to supply a power to the blower fan, with a center portion communicating with the channel.

* * * * *